US006651337B2

(12) United States Patent
Kirchner

(10) Patent No.: US 6,651,337 B2
(45) Date of Patent: Nov. 25, 2003

(54) PROCESS FOR EXCHANGING AN INTERMEDIATE ROLL IN A CALENDER

(75) Inventor: Markus Kirchner, Rheurdt (DE)

(73) Assignee: Voith Paper Patent GmbH, Heidenheim (DE)

( * ) Notice: Subject to any disclaimer, the term of this patent is extended or adjusted under 35 U.S.C. 154(b) by 169 days.

(21) Appl. No.: 09/932,921

(22) Filed: Aug. 21, 2001

(65) Prior Publication Data

US 2002/0043354 A1 Apr. 18, 2002

(30) Foreign Application Priority Data

Aug. 25, 2000 (DE) ..... 100 41 887

(51) Int. Cl.[7] ..... B21D 53/00

(52) U.S. Cl. ..... 29/895.1; 29/402.08; 29/426.1; 162/199

(58) Field of Search ..... 29/895.1, 402.08, 29/426.1; 492/60; 100/168; 162/199

(56) References Cited

U.S. PATENT DOCUMENTS

| | | | | |
|---|---|---|---|---|
| 2,058,352 A | | 10/1936 | Putnam et al. | |
| 3,584,570 A | * | 6/1971 | Sass et al. | 100/168 |
| 4,290,351 A | * | 9/1981 | Pav et al. | 100/47 |
| 4,784,596 A | * | 11/1988 | Heise | 100/168 |
| 4,932,827 A | * | 6/1990 | Schlunke et al. | 414/280 |
| 5,231,924 A | * | 8/1993 | Schneid | 100/168 |
| 5,513,560 A | * | 5/1996 | Downing et al. | 100/168 |
| 6,247,398 B1 | | 6/2001 | Kayser et al. | |

FOREIGN PATENT DOCUMENTS

| | | | |
|---|---|---|---|
| DE | 19856517 | | 6/2000 |
| EP | 0979896 | | 2/2000 |
| JP | 5-9889 | * | 1/1993 |
| JP | 6-17397 | * | 1/1994 |
| JP | 6-65887 | * | 3/1994 |

* cited by examiner

*Primary Examiner*—David P. Bryant
(74) *Attorney, Agent, or Firm*—Greenblum & Bernstein, P.L.C.

(57) ABSTRACT

Process for exchanging an intermediate roll in a calender and a calender. The calender has more than three rolls arranged to form a pressing plane obliquely oriented at a predetermined angle to a vertical, the intermediate roll to be exchanged being positioned immediately above a neighboring roll. The process includes lowering the neighboring roll at least a distance h defined by the equation:

$$h=(r_1+r_2)(1-\cos\alpha),$$

in which $r_1$ is a radius of the intermediate roll, $r_2$ is a radius of the neighboring roll, and $\alpha$ is the predetermined angle, and substantially horizontally removing the intermediate roll to be exchanged.

18 Claims, 3 Drawing Sheets

PROCESS FOR EXCHANGING AN INTERMEDIATE ROLL IN A CALENDER

CROSS-REFERENCE TO RELATED APPLICATIONS

The present application claims priority under 35 U.S.C. §119 of German Patent Application No. 100 41 887.2, filed on Aug. 25, 2000, the disclosure of which is expressly incorporated by reference herein in its entirety.

BACKGROUND OF THE INVENTION

1. Field of the Invention

The invention relates to a process for exchanging an intermediate roll in a calender having more than three rolls, whose pressing plane is inclined at a predetermined angle to the vertical. The invention also relates to a calender with a roll stack having more than three rolls whose pressing plane is inclined at a predetermined angle to the vertical.

2. Discussion of Background Information

Such a calender is known from EP 0 979 896 A2. It is used for glazing webs of paper or similar material. The arrangement of the rolls in a plane inclined to the vertical has several advantages. For example, an arrangement which occurs at an angle of about 45° to the vertical allows the influence of weight forces of the rolls on the material web to be glazed to be somewhat reduced. Moreover, the rolls are at least somewhat more accessible than in a calender with a vertical roll stack.

However, in a calender with an inclined roll stack, it is necessary from time to time to exchange a roll. This is the case, for example, when the roll in question has markings or has been otherwise damaged.

In the known case, the roll in question is then pushed out of the roll stack essentially perpendicular to the pressing plane. It can then be picked up and removed by an indoor crane. The installation occurs in the reverse order, i.e., the indoor crane lays the roll onto the ejection device. Then the roll is placed back in its working position in the roll stack in an essentially perpendicular manner.

Such a process has essentially proven itself. However, it is relatively expensive because a device must be present for each roll, at least for each intermediate roll, with which the roll in question can be displaced perpendicular to the pressing plane. This results in a considerable expense.

SUMMARY OF THE INVENTION

The present invention, therefore, facilitates a roll change in calenders arranged diagonally.

Accordingly, the instant invention is directed to a process of the type mentioned at the outset which also includes that at least the rolls located below the intermediate roll are lowered, with the neighboring roll below the intermediate roll forming a maneuvering gap with the intermediate roll and the neighboring roll additionally being lowered by an amount h that is defined by the equation:

$$h=(r_1+r_2)(1-\cos\alpha)$$

where $r_1$ is the radius of the intermediate roll, $r_2$ is the radius of the neighboring roll, and $\alpha$ is the angle of the roll stack.

With this embodiment, it becomes possible for the intermediate roll to be exchanged to be moved horizontally without colliding with the lower neighboring roll. Therefore, it is possible during an exchange to simply grip the intermediate roll and remove it from the calender with the aid of the indoor crane without hitting the neighboring roll located beneath it. When the intermediate roll has covered a predetermined distance in the horizontal direction, it can be lifted. However, this lifting occurs at a distance from the rolls located above the intermediate roll, thus excluding the possibility of a collision. This process does indeed require that the rolls located below the intermediate roll to be exchanged be lowered over a relatively large distance. At an incline angle of 45°, the lower rolls must be lowered by approximately 30% of the sum of the radii of the intermediate roll and the neighboring roll. However, the savings in time is considerable. Above all, however, the danger of damage during removal and installation of the intermediate rolls is quite drastically reduced. Because it is no longer necessary to provide each intermediate roll with its own device for ejection of the roll, the calender can be constructed in a substantially more cost-effective fashion than before. The large lowering movement must only be performed when the intermediate rolls are exchanged. If the opening of nips should become necessary for another reason, for example, in the case of a web tear or for the purpose of threading a material web, this can occur using nip openings like before, i.e., using nip openings on an order of magnitude of approximately 10 mm.

Preferably, the neighboring roll is moved laterally at the same time by an amount s, which is defined by the equation:

$$s=h\cdot\tan\alpha.$$

With this construction, it is achieved that, upon lowering the neighboring roll, a relatively large lateral distance from between the neighboring roll and the intermediate roll is achieved, such that the further movement of the intermediate roll can occur with even greater freedom of movement.

Preferably, gaps between the rolls below the intermediate roll are adjusted to a size that corresponds to that of the maneuvering gap. Thus, when the rolls located below the intermediate roll are lowered, distances between these rolls are maintained, such that the danger of accidental damage remains small.

Preferably, the size of the maneuvering gaps is set to about 8 to 15 mm. This size has proven itself. A preferred measurement in this connection is about 10 mm.

Preferably, the rolls below the intermediate roll are moved essentially in the pressing plane. In this type of process, it is possible to move the rolls along a lateral edge of the frame such that no additional directions in which the rolls are moved must be added to the adjustment. Here, the rolls need not move precisely in the pressing direction. For example, they can also be mounted on levers that are pivoted. The movement of the rolls therefore corresponds to a small arch. In the present case, however, this arch is seen as still lying in the pressing plane.

Preferably, stops are adjusted for the rolls located below the intermediate roll in order to select the intermediate roll. Depending on which intermediate roll must be exchanged, it is necessary to lower a larger or smaller number of rolls located below it. This can be determined in a simple manner using stops that are adjusted accordingly.

Here, it is preferred for nuts on spindles to be used for adjusting the stops. Thus, a relatively precise adjustment of the stops can be achieved and a sufficiently high speed can be achieved as well.

Moreover, the present invention is directed to a calender of the type mentioned at the outset which also includes that the rolls under an intermediate roll to be exchanged may be lowered by an amount h that is defined by the equation:

$$h=(r_1+r_2)(1-\cos\alpha)$$

where $r_1$ is the radius of the intermediate roll, $r_2$ is the radius of the neighboring roll, and $\alpha$ is the angle of the roll stack.

In such a calender, the rolls neighboring one intermediate roll to be exchanged can be lowered sufficiently far that the intermediate roll can be moved horizontally for installation and removal with the aid of, e.g., an indoor crane. However, such horizontal movement is relatively easy to control. Because that neighboring roll and naturally the rolls located under it as well may be lowered by the corresponding amount, i.e., the above-mentioned distance, they are no longer in the way of the horizontal movement of the intermediate roll. The removal and installation of the intermediate roll are therefore simplified even though the rolls located below it must be lowered by a relatively large distance.

Preferably, the rolls can be moved during lowering in a manner that is essentially parallel to the pressing plane. The devices used for mounting of the rolls, for example, the seating or the frame, can now also be used for guiding the rolls during lowering. This keeps the additional expense low.

Preferably, the rolls, with the optional exception of one upper roll and one lower roll, are mounted on levers that are arranged in a frame in a pivotable fashion, with an adjustable stop being assigned to each lever. When the lower roll is lowered, the levers of all rolls mounted above it fall downwards until they come to rest against the stop. The position of the respective stop thus determines the position of the roll after opening. Thus, by selecting the individual stops, it is possible to simply determine which of the intermediate rolls should be sufficiently unblocked, so that an exchange is possible.

Preferably, the stops are formed by nuts that are mounted in a rotatable fashion on spindles. For example, these spindles can be suspension spindles as they are known from conventional supercalenders. Thus, it is possible to apply the experience gained in constructing supercalenders.

Preferably, a control device is provided for activating an adjustment device for the stops. Thus, it is possible to automate the adjustment of the stops and the selection of the rolls that are to be lowered far enough in order to facilitate the exchange of rolls.

The present invention is directed to a process for exchanging an intermediate roll in a calender having more than three rolls arranged to form a pressing plane obliquely oriented at a predetermined angle to a vertical, the intermediate roll to be exchanged being positioned immediately above a neighboring roll. The process includes lowering the neighboring roll at least a distance h defined by the equation:

$$h=(r_1+r_2)(1-\cos\alpha),$$

in which $r_1$ is a radius of the intermediate roll, $r_2$ is a radius of the neighboring roll, and $\alpha$ is the predetermined angle, and substantially horizontally removing the intermediate roll to be exchanged.

According to a feature of the instant invention, before lowering the neighboring roll, the process can further include lowering at least the rolls located below the intermediate roll. A maneuvering gap can be formed between the neighboring roll and the intermediate roll.

Moreover, the neighboring roll can be lowered a distance corresponding to a sum of the maneuvering gap and distance h.

Further, gaps can be formed between each of the lowered rolls located below the intermediate roll, which correspond to a size of the maneuvering gap. The gap size can be within a range of about 8 to 15 mm, and, preferably, is about 10 mm.

Still further, the lowered rolls located below the intermediate roll may be moved essentially within the pressing plane.

Displacing stops may be provided for the rolls located below the intermediate roll. The stops can include nuts which are displaceable along spindles, and the displacing of the stops may include displacing the nuts on the spindles.

According to another feature of the invention, the neighboring roll can be substantially simultaneously moved laterally by a distance s defined by the equation:

$$s=h\cdot\tan\alpha.$$

The present invention is directed to a calender that includes a roll stack having more than three rolls arranged to form a pressing plane obliquely oriented at a predetermined angle to vertical. The roll stack includes an intermediate roll to be exchanged and a neighboring roll positioned immediately below the intermediate roll to be exchanged, and the neighboring roll is structured and arranged to be lowered at least a distance h from the intermediate roll, the distance h being defined by an equation:

$$h=(r_1+r_2)(1-\cos\alpha),$$

in which $r_1$ is a radius of the intermediate roll, $r_2$ is a radius of the neighboring roll, and $\alpha$ is the predetermined angle.

In accordance with a feature of the instant invention, the rolls located below the intermediate roll to be exchanged may be structured and arranged to be lowered to facilitate exchange of the intermediate roll to be exchanged. Further, when the rolls located below the intermediate roll to be exchanged are lowered, the rolls may be moved essentially parallel to the pressing plane.

According to another feature of the invention, a frame, levers, and displaceable stops can be provided, and the roll stack can include an upper roll, a lower roll, and a plurality of intermediate rolls arranged between the upper roll and the lower roll. The plurality of intermediate rolls may be pivotably coupled to the frame by the levers, and one of the displaceable stops can be associated with each of the levers. The displaceable stops can include nuts displaceably mounted on spindles. A control device may be arranged to control displacement of the displaceable stops. Further, the displaceable stops may include a displacement device coupled to the control device.

The instant invention is directed to a process to facilitate removal and/or exchange of an intermediate roll in a calender having at least four rolls arranged to form a pressing plane obliquely oriented at a predetermined angle to a vertical, the intermediate roll to be exchanged being positioned immediately above a neighboring roll. The process includes releasing the rolls located below the intermediate roll to be exchanged from pressing engagement with the roll stack, and lowering the neighboring roll at least a distance h defined by the equation:

$$h=(r_1+r_2)(1-\cos\alpha),$$

in which $r_1$ is a radius of the intermediate roll, $r_2$ is a radius of the neighboring roll, and $\alpha$ is the predetermined angle.

According to a feature of the invention, before lowering the neighboring roll, the process may further include lowering the rolls released from pressing engagement with the roll stack. A maneuvering gap may be formed at least between the neighboring roll and the intermediate roll. The neighboring roll can be lowered a distance corresponding to a sum of the maneuvering gap and distance h.

In accordance with another feature of the instant invention, the neighboring roll can be substantially simultaneously moved laterally by a distance s defined by the equation:

$$s=h\cdot\tan\alpha.$$

The rolls released from pressing engagement with the roll stack may be lowered to form gaps which correspond at least to a size of the maneuvering gap. The gap size can be about 10 mm.

Moreover, the lowering of the neighboring roll may include downwardly moving a displaceable stop associated with a lever coupling the neighboring roll to a calender frame in a downward direction a distance sufficient to lower the neighboring roll at least the distance h. The displaceable stop can include a nut which is displaceable along a spindle, and the downward moving of the displaceable stop may include rotating the spindle to effect downward movement of the nut.

The instant invention is directed to a calender including at least four rolls arranged in a roll stack to form a pressing plane obliquely oriented at a predetermined angle to vertical. The at least four rolls include an intermediate roll to be exchanged and a neighboring roll positioned immediately below the intermediate roll to be exchanged, and the neighboring roll is structured and arranged to be lowered at least a distance h from the intermediate roll, the distance h being defined by an equation:

$$h=(r_1+r_2)(1-\cos\alpha)$$

in which $r_1$ is a radius of the intermediate roll, $r_2$ is a radius of the neighboring roll, and $\alpha$ is the predetermined angle.

In accordance with yet another feature of the instant invention, the calender may include a frame, levers, and displaceable stops, and the at least four rolls can include an upper roll, a lower roll, and a plurality of intermediate rolls arranged between the upper roll and the lower roll. The plurality of intermediate rolls may be pivotably coupled to the frame by the levers, and one of the displaceable stops can be associated with each of the levers. Further, the displaceable stops may include nuts displaceably mounted on spindles.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
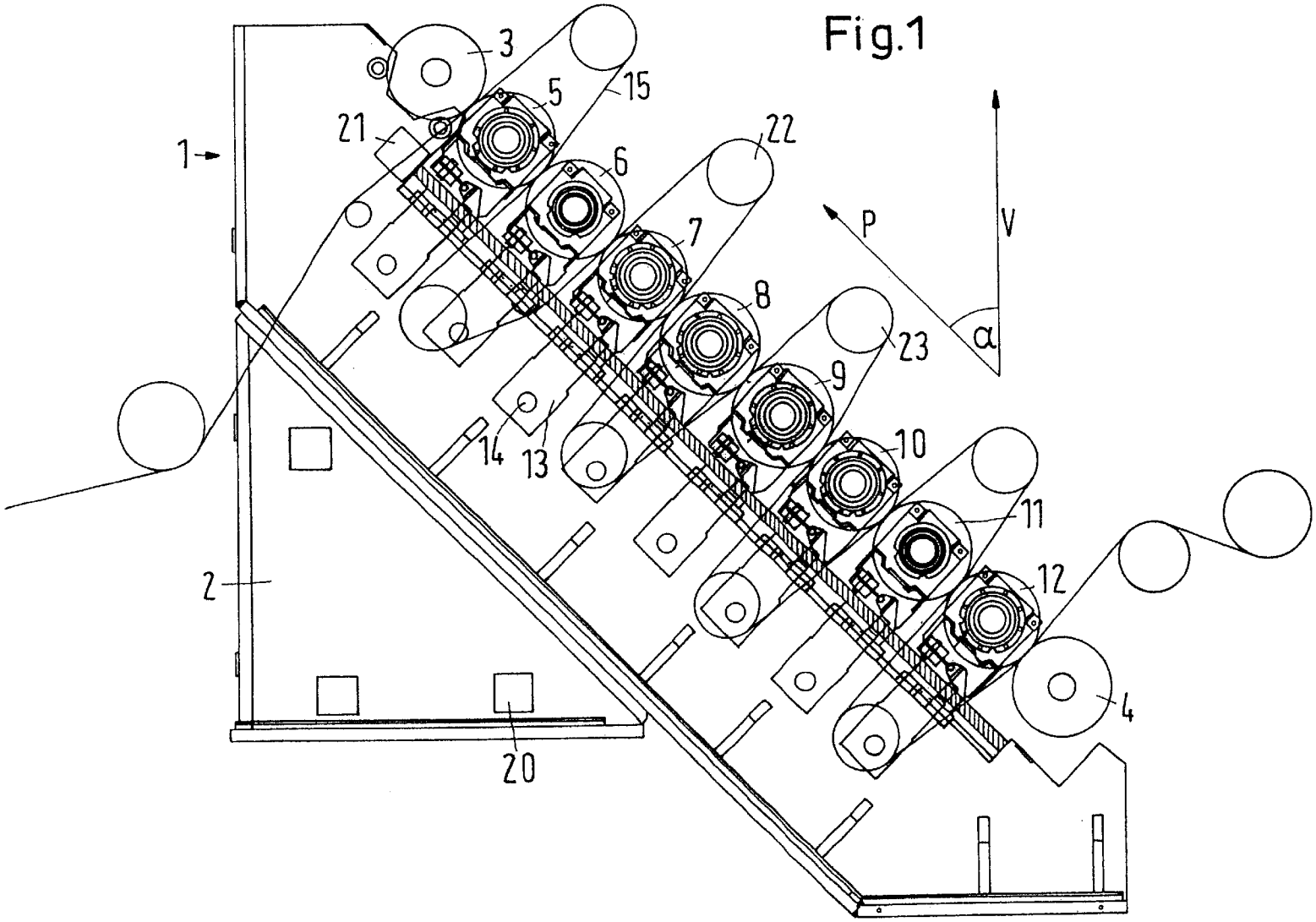
FIG. 1 illustrates a calender in a schematic side view.

FIG. 1 shows a calender 1 with a frame 2 in which one upper roll 3 and one lower roll 4 and a plurality of intermediate rolls 5–12 therebetween are arranged, i.e., this is a 10-roll calender. Upper roll 3 and lower roll 4 are embodied or formed as sag (deflection) compensation rolls. The axes of rolls 3–12 lie essentially in a same plane, the so-called "pressing plane." The pressing plane runs parallel to a direction P that is indicated by an arrow, and direction P forms an angle $\alpha$ with vertical reference V of approximately 45° in this exemplary embodiment. However, it is noted that deviations from this angle by ± about 10° are quite permissible.

Intermediate rolls 5–12 are mounted on levers 13, which are in turn mounted on frame 2 by way of pivot axes 14.

Lower roll 4 is movable in the direction of the pressing plane with the aid of, e.g., a hydraulic cylinder (which is not shown in greater detail). If lower roll 4 has been moved in the direction of upper roll 3, individual rolls 3–12 form a plurality of nips in which a material web 15, e.g., a paper web or other comparable web, is subjected to increased pressure and, optionally, to increased temperature, in a manner which is known per se. In a manner that is also known, some of rolls 3–12 can have an elastic or flexible surface. Further, it is quite permissible for the axes of individual rolls 3–12 not to lie in the pressing plane in a mathematically precise fashion, i.e., can also be arranged slightly offset to it in a lateral (cross-wise) direction.

When lower roll 4 is moved in the direction away from upper roll 3, the nips between individual rolls 3–12 open because the rolls on their levers 13 "fall" in a downward direction under the effect of gravity. Such an opening of the nips can be necessary, e.g., for threading paper web 15 through calender 1. In fact, it is absolutely necessary when an error, e.g., web tears, occur.

In the case of such an opening, it is generally desirable to achieve a distance between adjacent rolls that is not too great. Distances on the order of approximately 10 mm are common. In order to maintain these distances, a stop 16 is provided for each lever 13, which is shown schematically here in the form of a nut 17 (see, e.g., FIG. 3) and can be rotated on a suspension spindle 18. A holding device 19 that can be controlled by way of a control device 20 is assigned to each nut 17 that secures nut 17 in a non-rotational manner in one operating state, i.e., holds it, and sets it loose in another operating state, i.e., allows it to rotate freely. However, as a rule, this free rotation is only possible in the unloaded state, i.e., when the nips between the rolls 3–12 are closed.

Suspension spindle 18 is known from supercalenders with pressing planes oriented in a vertical (perpendicular) fashion. It is suspended in the region of the upper roll and has a drive 21 located there. In this manner, it is possible to adjust stops 16 by rotating hanging spindle 18 via drive 21 so that spindle 18 either holds respective nuts 17 fast in order to adjust them or releases them in order to maintain their position.

Figure 2:
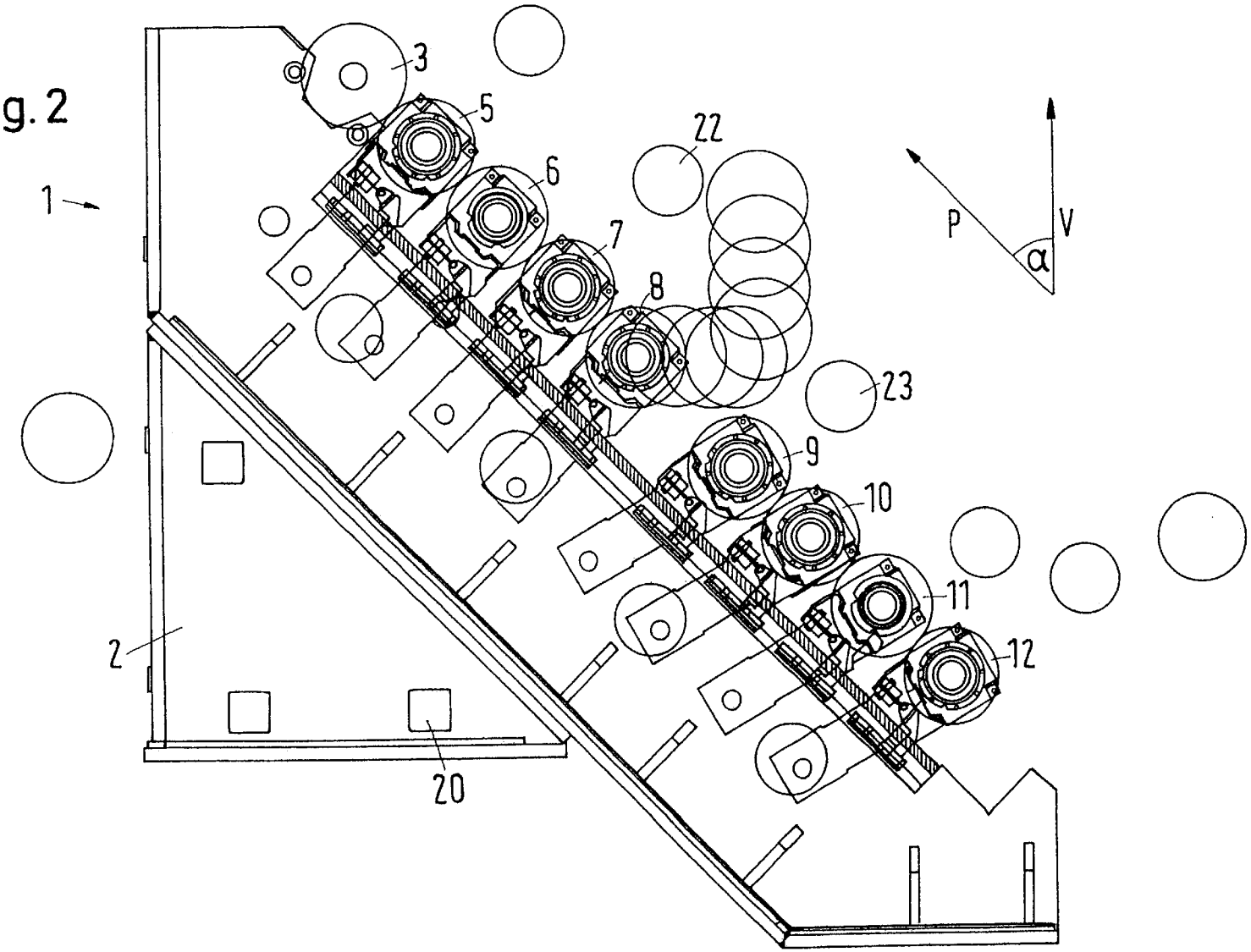
FIG. 2 illustrates a side view of the calender depicted in FIG. 1 during removal of an intermediate roll.

If, e.g., it is desired to remove one roll, i.e., intermediate roll 8 (see FIG. 2) from the roll stack, nuts 17 of rolls 9–12, i.e., the rolls located below intermediate roll 8, are moved substantially farther downwards such that rolls 9–12 can be moved substantially farther downward, as depicted in FIG. 2. In contrast, the position of nut 17*a* (FIG. 3) of intermediate roll 8, which is to be exchanged, remains essentially unchanged. However, a small pivot movement of lever 13*a* of intermediate roll 8 can be tolerated or allowed in order to enable intermediate roll 8 to move a short distance from the above positioned intermediate roll 7.

Intermediate roll 9, which is positioned directly below intermediate roll 8 to be exchanged, will be referred to in the following as the "neighboring roll." In addition to the gap formed between intermediate roll 8 and neighboring roll 9, when rolls 9–12 are moved downwardly and away from intermediate roll 8, corresponding gaps are formed between these rolls, i.e., between neighboring roll 9 and roll 10; between roll 10 and roll 11, and between roll 11 and roll 12. While these gaps are not depicted in FIG. 3, these gaps have a size that corresponds to the size of a conventional maneuvering gap, which is generally necessarily provided for threading web 15 through calender 1. A conventional maneuvering gap may be, e.g., between about 8 mm and 15 mm, and preferably about 10 mm.

Figure 3:
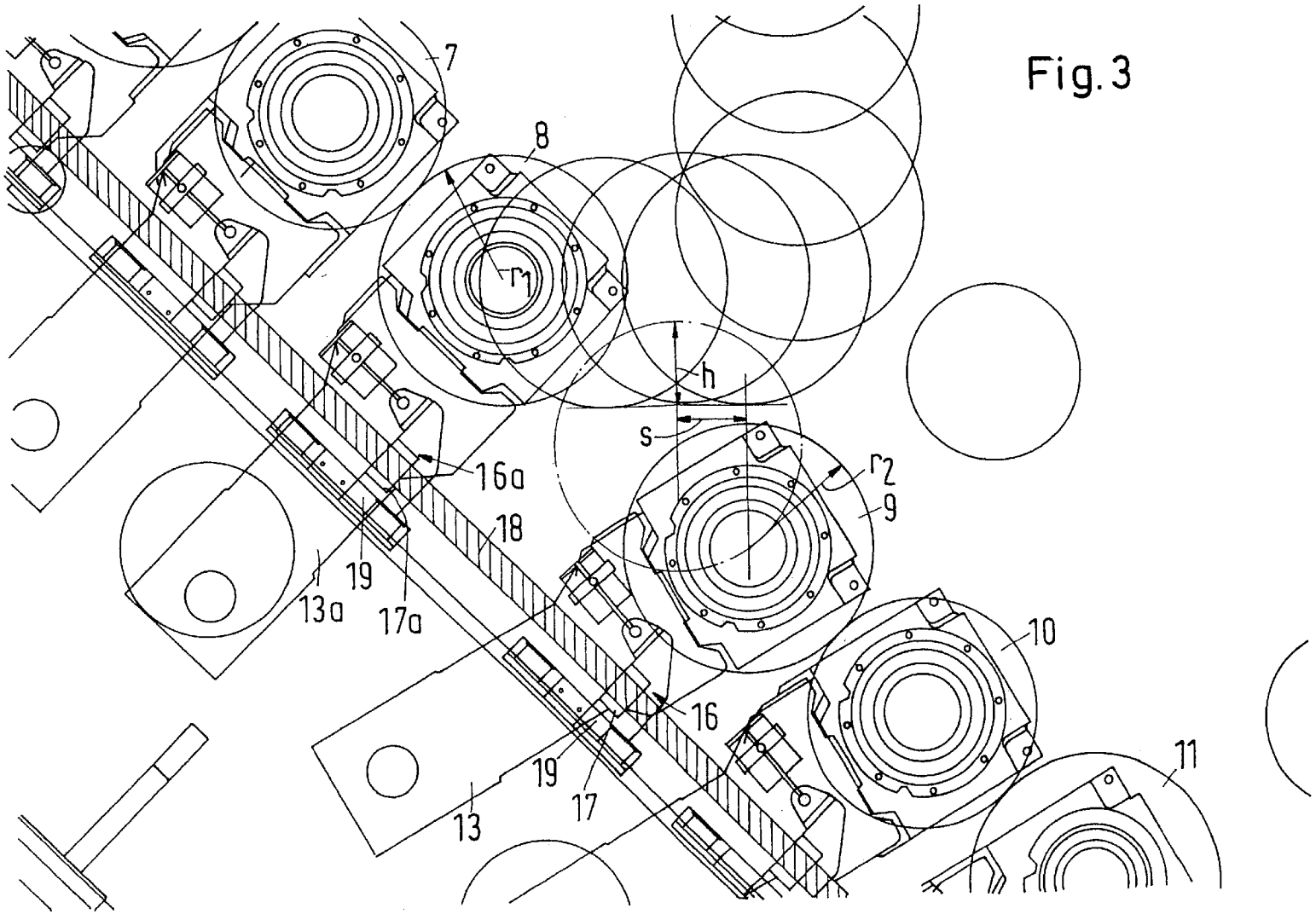
FIG. 3 illustrates an enlarged section of FIG. 2.

Now, neighboring roll 9 and intermediate rolls 10–12 arranged below neighboring roll 9 are further lowered to enable intermediate roll 8 to be exchanged via a horizontal movement without colliding with neighboring roll 9. This horizontal exchanging movement is depicted in FIGS. 2 and 3 by various positions of intermediate roll 8 during removal and installation using circles. Thus, after neighboring roll 9 has been sufficiently lowered, intermediate roll 8 is first moved horizontally far enough so that it can be moved vertically between two guidance rolls 22 and 23, over which material web 15 is guided during operation.

The necessary freedom of movement is then created when neighboring roll 9 is lowered by a height h, which is dependent upon the radius $r_1$ of intermediate roll 8 and the radius $r_2$ of neighboring roll 9. Moreover, height h is dependent upon angle of inclination $\alpha$ of the pressing plane P with respect to vertical V. Accordingly, height h can therefore be determined from the equation:

$$h=(r_1+r_2)(1-\cos\alpha).$$

Because neighboring roll 9 is also arranged on a lever 13, the movement of neighboring roll 9 during lowering does not occur exclusively in the direction of vertical V. That is, neighboring roll 9 is also laterally displaced by a distance s, i.e., in the horizontal direction, which can be determined from the equation:

$$s=h\cdot\tan\alpha.$$

Because lowered intermediate rolls 9–12 are pivoted by levers 13 relative to frame 2 during lowering, these describe an arc-like motion. However, the pivot angle is relatively small such that this arc-like motion can still be essentially equated to a linear motion that is oriented essentially parallel to pressing plane P.

By selecting individual stops 16 and 16*a*, it is possible to determine which intermediate roll is to be removed. As mentioned above, stop 16*a* of intermediate roll 8 (which is to be removed) can be lowered only slightly or practically not at all, while the stop of neighboring roll 9 must be displaced by a length 1 that can be determined from the equation:

$$l^2=h^2+s^2.$$

Naturally, in all displacement motions, it will be taken into account that a certain movement reserve is needed. Correspondingly, it is useful to lower neighboring roll 9 by somewhat more than height h and/or to displace nut 17 by somewhat more than length 1. A good measurement for this addition is the above-mentioned maneuvering gap in an order of magnitude of approximately 10 mm.

Instead of a continuous suspension spindle 18, as depicted in the Figures, it is also possible to use a divided suspension spindle.

The exchange of upper roll 3 or lower roll 4 is possible in the diagonally arranged calender with minimal expense. That is, if necessary, upper roll 3 can be removed from the roll stack vertically, while lower roll 4 can be removed from the roll stack horizontally.

If a 2×5 roll calender is used instead of the 10-roll calender roll depicted in the exemplary embodiment, the same considerations will apply to the lower roll of the upper calender segment and to the upper roll of the lower calender segment as for intermediate rolls 5–12 of the calender depicted in FIGS. 1 and 2.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for exchanging an intermediate roll in a calender having more than three rolls arranged to form a pressing plane obliquely oriented at a predetermined angle to a vertical, the intermediate roll to be exchanged being positioned immediately above a neighboring roll, the process comprising:

lowering the neighboring roll at least a distance h defined by the equation:

$$h=(r_1+r_2)\ (1-\cos\alpha),$$

wherein $r_1$ is a radius of the intermediate roll, $r_2$ is a radius of the neighboring roll, and $\alpha$ is the predetermined angle; and substantially horizontally removing the intermediate roll to be exchanged.

2. The process in accordance with claim 1, wherein, before lowering the neighboring roll, the process further comprises:

lowering at least the rolls located below the intermediate roll, wherein a maneuvering gap is formed between the neighboring roll and the intermediate roll.

3. The process in accordance with claim 2, wherein the neighboring roll is lowered a distance corresponding to a sum of the maneuvering gap and distance h.

4. The process in accordance with claim 2, wherein gaps are formed between each of the lowered rolls located below the intermediate roll, which correspond to a size of the maneuvering gap.

5. The process in accordance with claim 4, wherein the gap size is within a range of about 8 to 15 mm.

6. The process in accordance with claim 4, wherein the gap size is about 10 mm.

7. The process in accordance with claim 2, wherein the lowered rolls located below the intermediate roll are moved essentially within the pressing plane.

8. The process in accordance with claim 2, further comprising displacing stops for the rolls located below the intermediate roll.

9. The process in accordance with claim 8, wherein the stops include nuts which are displaceable along spindles, and the displacing of the stops comprises displacing the nuts on the spindles.

10. The process in accordance with claim 1, wherein the neighboring roll is substantially simultaneously moved laterally by a distance s defined by the equation:
$s=h\cdot\tan\alpha$.

11. A process to facilitate removal and/or exchange of an intermediate roll in a calender having at least four rolls arranged to form a pressing plane obliquely oriented at a predetermined angle to a vertical, the intermediate roll to be exchanged being positioned immediately above a neighboring roll, the process comprising:

releasing the rolls located below the intermediate roll to be exchanged from pressing engagement with the roll stack; and lowering the neighboring roll at least a distance h defined by the equation:

$$h=(r_1+r_2)(1-\cos\alpha),$$

wherein $r_1$ is a radius of the intermediate roll, $r_2$ is a radius of the neighboring roll, and $\alpha$ is the predetermined angle.

12. The process in accordance with claim 11, wherein, before lowering the neighboring roll, the process further comprises:

lowering the rolls released from pressing engagement with the roll stack, wherein a maneuvering gap is formed at least between the neighboring roll and the intermediate roll.

13. The process in accordance with claim 12, wherein the neighboring roll is lowered a distance corresponding to a sum of the maneuvering gap and distance h.

14. The process in accordance with claim 11, wherein the neighboring roll is substantially simultaneously moved laterally by a distance s defined by the equation:

$$s=h\cdot\tan\alpha.$$

15. The process in accordance with claim 11, wherein the rolls released from pressing engagement with the roll stack are lowered to form gaps which correspond at least to a size of the maneuvering gap.

16. The process in accordance with claim 15, wherein the gap size is about 10 mm.

17. The process in accordance with claim 11, wherein the lowering of the neighboring roll comprises:

downwardly moving a displaceable stop associated with a lever coupling the neighboring roll to a calender frame in a downward direction a distance sufficient to lower the neighboring roll at least the distance h.

18. The process in accordance with claim 17, wherein the displaceable stop includes a nut which is displaceable along a spindle, and the downward moving of the displaceable stop comprises rotating the spindle to effect downward movement of the nut.

* * * * *